US010151063B2

(12) United States Patent
Antonsson et al.

(10) Patent No.: US 10,151,063 B2
(45) Date of Patent: Dec. 11, 2018

(54) COST EFFICIENT KRAFT COOKING METHOD USING POLYSULFIDE COOKING LIQUOR

(71) Applicant: Valmet AB, Sundsvall (SE)

(72) Inventors: Stefan Antonsson, Bandhagen (SE); Krister Olsson, Karlstad (SE)

(73) Assignee: Valmet AB (SE)

( * ) Notice: Subject to any disclaimer, the term of this patent is extended or adjusted under 35 U.S.C. 154(b) by 0 days.

(21) Appl. No.: 15/506,359

(22) PCT Filed: Aug. 26, 2014

(86) PCT No.: PCT/SE2014/050975

§ 371 (c)(1),
(2) Date: Feb. 24, 2017

(87) PCT Pub. No.: WO2016/032374

PCT Pub. Date: Mar. 3, 2016

(65) Prior Publication Data

US 2017/0275818 A1 Sep. 28, 2017

(51) Int. Cl.
*D21C 3/02* (2006.01)
*D21C 3/26* (2006.01)
(Continued)

(52) U.S. Cl.
CPC ..... *D21C 3/022* (2013.01); *D21C 1/06* (2013.01); *D21C 3/24* (2013.01); *D21C 3/26* (2013.01); *D21C 7/06* (2013.01)

(58) Field of Classification Search
CPC ..... D21C 3/022; D21C 3/26; D21C 7/06
See application file for complete search history.

(56) References Cited

U.S. PATENT DOCUMENTS 6,325,890 B1 12/2001 Prough et al.
6,866,748 B2 * 3/2005 Sundaram ..... D21C 11/0007 162/43
(Continued)

FOREIGN PATENT DOCUMENTS

EP 2268861 A1 1/2011
EP 2268862 A1 1/2011
(Continued)

OTHER PUBLICATIONS

Kraft Pulping Past Current and Future, by Hjort, Jan. 2012, Metso, p. 1-52.*
(Continued)

*Primary Examiner* — Anthony Calandra
(74) *Attorney, Agent, or Firm* — Lerner, David, Littenberg, Krumholz & Mentlik, LLP

(57) ABSTRACT

The invention is related to a method for the preparation of kraft pulp with increased pulping yield from lignin-containing cellulosic material using polysulfide cooking liquor. In order to obtain a cost efficient system both in aspects of investment costs but also in aspects of heat economy of operating the process is most of the total charge of alkali charged as heated polysulfide liquor to an first atmospheric vessel, wherein the hot polysulfide liquor flashes off steam providing most if not all of the necessary steaming effect for the cellulose material. The polysulfide liquor is then allowed to impregnate the cellulose material at a temperature closer to cooking temperature but still so low that essentially no delignification occurs in impregnation vessel, as the H-factor in impregnation vessel is kept within 1-20.

13 Claims, 1 Drawing Sheet

(51) Int. Cl.

| | |
|---|---|
| ***D21C 1/06*** | (2006.01) |
| ***D21C 7/06*** | (2006.01) |
| ***D21C 3/24*** | (2006.01) |

(56) References Cited

U.S. PATENT DOCUMENTS

| | | | | |
|---|---|---|---|---|
| 7,270,725 | B2 | 9/2007 | Lindstrom et al. | |
| 7,828,930 | B2 | 11/2010 | Jiang | |
| 9,580,864 | B2 * | 2/2017 | Lindstrom | D21C 3/022 |
| 2007/0187052 | A1 | 8/2007 | Snekkenes | |
| 2012/0216971 | A1 | 8/2012 | Trolin et al. | |
| 2013/0240167 | A1 | 9/2013 | Trolin et al. | |

FOREIGN PATENT DOCUMENTS

| | | | |
|---|---|---|---|
| EP | 2467533 | A1 | 6/2012 |
| EP | 2591165 | A1 | 5/2013 |
| SE | 523850 | C2 | 5/2004 |
| WO | 2013032377 | A1 | 3/2013 |

OTHER PUBLICATIONS

Chemical Pulping Part 1, Fibre Chemistry and Technology, Second edition, 2011, pp. 350-356, http://www.knowpulp.com/english/demo/english/pulping/cooking/1 process/1 principle/h-tekijan laskenta.htm.

Gullichsen, Johna; Fogelholm, Carl.Johan (2000), "Chemical Pulping", Papermaking Science and Technology 6A, tappi Publications, pp. 291-292.

International Search Report for Application No. PCT/SE2014/050975 dated Mar. 30, 2015.

* cited by examiner

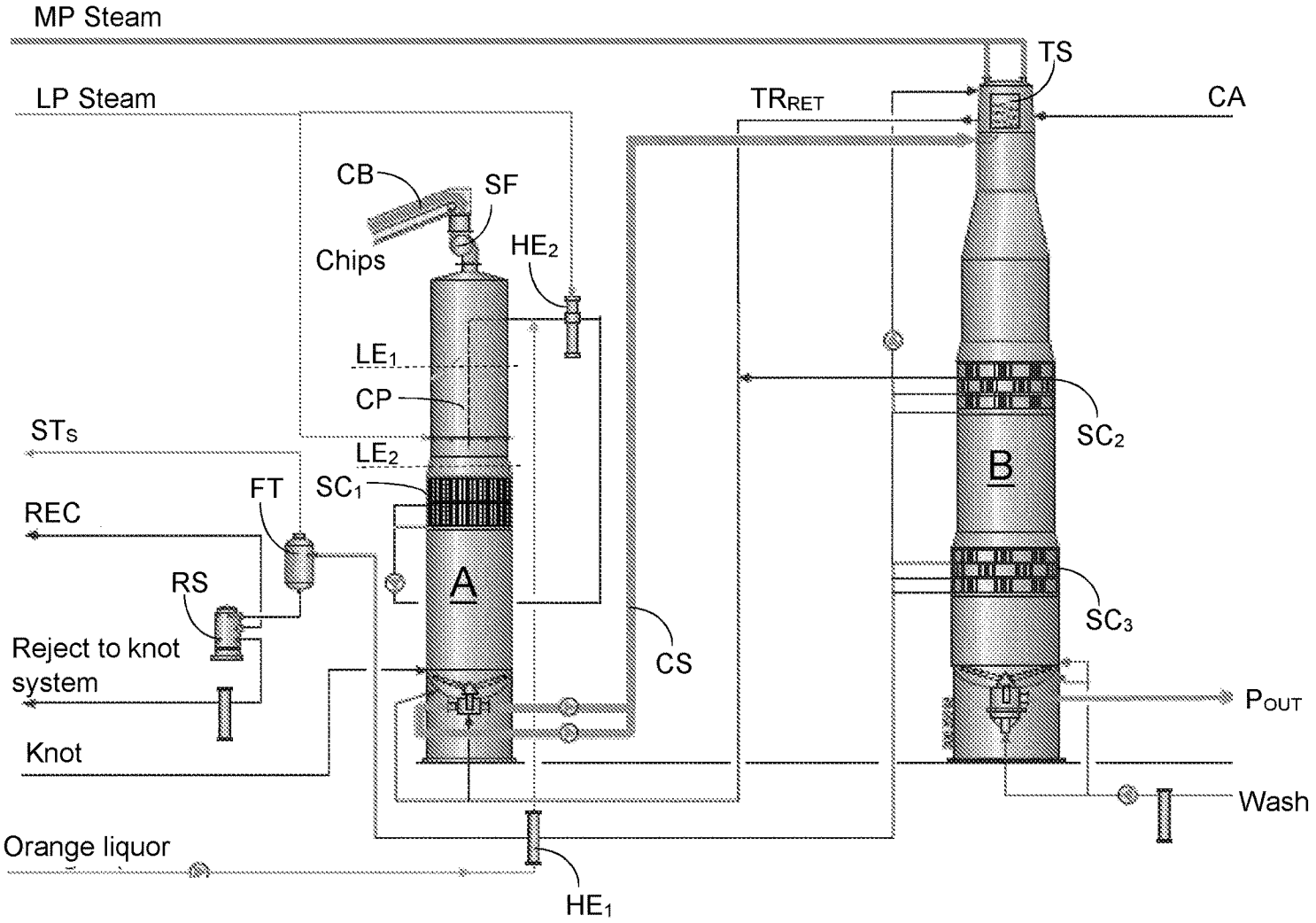
MP Steam
LP Steam
TS
CA
TR$_{RET}$
SC$_2$
B
SC$_3$
P$_{OUT}$
Wash
CS
HE$_2$
SF
CB
Chips
LE$_1$
CP
LE$_2$
SC$_1$
A
HE$_1$
FT
RS
ST$_S$
REC
Reject to knot system
Knot
Orange liquor

COST EFFICIENT KRAFT COOKING METHOD USING POLYSULFIDE COOKING LIQUOR

CROSS-REFERENCE TO RELATED PATENT APPLICATIONS

The present application is a national phase entry under 35 U.S.C. § 371 of International Application No. PCT/SE2014/050975 filed Aug. 26, 2014, published in English, which is incorporated herein by reference.

FIELD OF THE INVENTION

The present invention relates to a method for the preparation of kraft pulp with increased pulping yield from lignin-containing cellulosic material using polysulfide cooking liquor.

BACKGROUND OF THE INVENTION

In conventional kraft cooking implemented in the 1960-1970-ies in continuous digesters was the total charge of white liquor added to the top of the digester. It soon emerged that the high alkali concentrations established at high cooking temperatures was detrimental for pulp viscosity.

Cooking methods was therefore developed in order to reduce the detrimental high alkali peak concentrations at start of the cook, and thus was split charges of alkali during the cook implemented in cooking methods such as MCC, EMCC, ITC and Lo-Solids cooking.

Other cooking methods was implemented using black liquor impregnation ahead of cooking stages where residual alkali in the black liquor was used to neutralize the wood acidity and to impregnate the chips with alkaline sulfide. One such cooking method sold by Valmet is Compact Cooking where black liquor with relatively high residual alkali level is withdrawn from earlier phases of the cook and charged to a preceding impregnation stage.

One aspect of alkali consumption during the cooking process, i.e. including impregnation, is that a large part of the alkali consumption is due to the initial neutralization of the wood, and as much as 50-75% of the total alkali consumption is occurring during the neutralization and alkali impregnation process. Hence, a lot of alkali is needed to be charged to the initial alkalization. This establish a cumbersome problem as high alkali concentrations had been found to be detrimental for pulp viscosity when charged to top of digesters in conventional cooking. One solution to meet the high alkali consumption and necessity to reduce alkali concentration at start of the cooking process was to charge large volumes of alkali treatment liquors, preferably black liquor having a residual alkali content, but having low alkali concentration, which resulted in presence of relatively large amount of total alkali per kg of wood material but still at low alkali concentration.

IN U.S. Pat. No. 7,270,725 (=EP1458927) Valmet disclosed a pretreatment stage using polysulfide cooking liquor ahead of black liquor treatment. In this process was the polysulfide treatment liquor drained after the pretreatment stage and before starting the black liquor treatment. The polysulfide treatment stage was also preferably kept short with treatment time in the range 2-10 minutes.

In a recent granted US patent, U.S. Pat. No. 7,828,930, International Paper, is shown an example of a kraft cooking process where 100% of the cooking liquor, in form of polysulfide liquor also named as orange liquor, is charged to top of digester and start of an impregnation stage. Here is also the temperature raised from 60° C. to 120° C. at start of the polysulfide treatment stage. However, as shown in example 1 is a liquor to wood ratio of about 3.5 established in the top of the digester by adding a proper amount of water. This order of liquor/wood ratio is often perceived as a standard liquor/wood ratio in continuous cooking necessary for a steady process. According to this proposal is a part of the residual polysulfide treatment liquor at relative high alkali concentration withdrawn and replaced with cooking liquor at relative low alkali concentration at start of the cooking stage, and the withdrawn residual polysulfide treatment liquor is added at later stages of the cook.

In Valmet's recent application WO2013032377 is disclosed a most beneficial method for a polysulfide kraft cooking process. The principles with a low temperature first impregnation stage with polysulfide cooking liquor at low liquor-to-wood ratio in the range 2.0 to 3.2 are disclosed. All the advantages with such conditions are disclosed and are included by reference also to the present invention which fully utilize these conditions. However, the system disclosed in WO2013032377 use a pressurized impregnation vessel preceded by a sluice feeder which may led to higher temperatures in the impregnation vessel for the polysulfide impregnation.

One model to describe cooking conditions is the H-factor. H-factor is a kinetic model for the rate of delignification in kraft pulping. It is a single variable model combining temperature (T) and time (t) and assuming that the delignification is one single reaction. If the activation energy is assumed to correspond to 134 kJ/mol the H-factor could be determined by;

$$H=\int_0^t \exp(43.2-16115/T)dT$$

This one single reaction model is described in Gullichsen, Johan; Fogelholm, Carl. Johan (2000), "Chemical Pulping", Papermaking Science and technology 6A, Tappi Publications, pp. 291-292, and is used throughout the pulping community to define cooking references, and will be used in this patent to define conditions of the cook. There is also an online H-factor calculator, using the single reaction model as outlined above, available at internet at http://www.knowpulp.com/english/demo/english/pulping/cooking/1_process/1_principle/h-tekijan_laskenta.htm, where one could calculate the H-factor for any given stage of the cook, i.e. during heat up (typically during impregnation) as well as during cooking (at full cooking temperature), and the total H-factor established in those stages.

This low H-factor is also disclosed in WO2013032377, and with the H-factor model used as disclosed above, following H-factors apply for respective retention time and temperatures (Time*Temp=H);

60*90=0; 60*100=1; 60*110=3, 60*120=9
90*90=0; 90*100=1; 90*110=5; 90*120=13
120*90=1; 120*100=2; 120*110=6; 120*120=18

Even though slightly different H-factors, or different activation energy than 134 kJ/mol, may apply during the cook, i.e. during initial-, bulk- and final delignification respectively is the same H-factor used for the entire cook, including impregnation and heat up phases for comparative studies, which also is the case in a number of scientific studies published. There are also different H-factors for different wood species, especially between annual plant, hardwood and softwood, but for this patent application is the above identified H-factor, using an activation energy of 134 kJ/mol, used as the base reference for all kinds of wood and all phases of the cook. The H-factor is the best parameter to define process parameters for delignification activity. Hence, an H-factor of 1 is indicating almost no delignification, in cooking processes most often requiring a total H-factor of about 300-1500, and typically about 700 for fully bleached qualities, indicating that only some single digit of percent of total delignification work has been obtained at a H-factor of 1. If a H-factor of only 300 is necessary for the final pulp, as could be the case in high yield cooks, a H-factor of 1 is only indicating that 1/300 of total delignification work is obtained during impregnation, i.e. less than 0.4%.

There has thus been an ongoing development of cooking methods where both alkali concentrations at start of cook is reduced, and increased yield from the cooking process is sought for using among others addition of polysulfide cooking liquor that stabilize the carbohydrates.

SUMMARY OF THE INVENTION

The invention is based upon an improved and simplified impregnation process that guarantees that low temperature conditions are established in the polysulfide impregnation process, while reducing the necessary equipment for the process. There is thus no need to install a high pressure feeding system and a top separator in the impregnation vessel as for example shown in WO2013032377 outlining the principles with low temperature impregnation at low liquid-to-wood ratio. According to the inventive process is also the heat economy of the entire cooking process improved as the polysulfide impregnation process is kept at as high temperature as possible, utilizing the heat value in the polysulfide as well as decreasing the heating needs in subsequent cooking process that needs to raise the temperature to full cooking temperature.

The invention fully utilize the process conditions as outlined in WO2013032377, but as far lower investment costs, utilizing the ImpBin™ concept from black liquor impregnation systems in Compact Cooking™ systems all systems developed and sold by Valmet AB.

The Compact Cooking and ImpBin concepts are disclosed in *Chemical Pulping Part* 1, *Fibre Chemistry and Technology*, Second edition, 2011, pages 350-356, and use an atmospheric impregnation vessel for combined steaming and impregnation, but with addition of hot black liquor flashing off steam for the necessary steaming of chips. With the inventive process is however the risk for emission of malodorous gases reduced to a minimum as no non condensable sulfur gases such as methyl mercaptans are contained in the impregnation liquid used.

Thus the ImpBin concept may thus be modified from cold top control of steam heating, to hot top, i.e. steam blow through in top of impregnation vessel such that a cleaner grade of turpentine may be extracted from the vented gases. The cold top control of the impregnation vessel in conventional black liquor impregnation using an ImpBin is disclosed on page 356 in said book *Chemical Pulping Part* 1, second edition.

One object of the present invention is to provide for a method for the preparation of kraft pulp with increased pulping yield from lignin-containing cellulosic material using polysulfide cooking liquor, comprising:

feeding not previously steamed lignin containing cellulosic material to the top of a first vertical first vessel operating at an applied pressure in the top of the vessel of at most 0.2 bar, and preferably of at most 0.1 bar, and establishing an upper level of lignin containing cellulosic material in the first vessel;

charging at least 80% of the total charge of the alkaline cooking liquor, in form of polysulfide liquor, to the first vessel and establishing a lower level of liquor below said upper level, said polysulfide liquor heated to a temperature above the boiling point before addition of the polysulfide liquor allowing steam to boil off from the polysulfide liquor and thus steam the lignin containing cellulosic material kept in a volume above the lower level of liquor;

keeping the suspended lignin containing cellulosic material in the first vessel for a time reaching an H-factor of at least 1, and preferably an H-factor between 1-20;

feeding the suspended lignin containing material from the bottom of the first vessel to the top of a vertical second vessel where the lignin containing cellulosic material is cooked at full cooking temperature in the range 130-160° C. to a final kappa number below 40, while adding any of the remaining charge of the alkaline cooking liquor, preferably in form of polysulfide liquor, during feeding to or cooking in the second vessel.

With this process is the process system simplified considerably, as the first vessel is used both as a steaming vessel for the cellulose material as well as a thorough impregnation of the cellulose material with polysulfide cooking liquor. There is no need to install an expensive high pressure feeding system and associated top separator in top of first vessel, as instead a simple conveyor belt may feed the cellulose material to the top and using a low pressure sluice feeder for feeding the cellulose material into the top of the first vessel. As the vessel is atmospheric is the temperature maintained at about 100° C. in liquor surface and no uncontrolled increase of temperature could be established due to exothermic reactions or excessive charges of hotter liquors in bottom of vessel, as all over temperatures results in water evaporating from the liquor surface, i.e. a self-controlling system. The only temperature increase that is developed is preferably the temperature increase due to exothermic reactions that may increase the temperature in the liquor corresponding to the boiling temperature at the existing static head in the vessel. Thus, 10 meter below the liquid level the liquid may assume a temperature of about 120° C., and 20 meter below the liquid level the temperature may be 133° C. at the most, if the pressure at the liquid level is atmospheric pressure. Hence, in an atmospheric vessel the temperature is not exceeding 100° C. at the liquid surface, and some exothermic heating may be developed during the downward flow of the suspension, and in bottom could hotter liquids be added without causing boiling, up to 133° C. if 20 meter liquid head is established.

An alternative objective is to enable a process system that could be changed between polysulfide impregnation or black liquor impregnation ahead of kraft cooking, with only changes in liquor routing between the two cooking modes.

According to one preferred embodiment of the method is additional steam added to the volume of the lignin containing cellulosic material kept above the lower level of liquor. This option may be needed in pulp mills in cold climate, as the cellulose material may have a temperature at existing ambient conditions, i.e. be deep frozen at some −30 to −40° C. But in normal operation is the steam released from the polysulfide liquor addition fully sufficient.

According to another preferred embodiment of the method is a part of the liquor volume in the first vessel withdrawn from the wall of the first vessel and circulated back to the volume of the lignin containing cellulosic material in a first circulation. In this embodiment is preferably the first circulation heated from a heat source.

Alternatively or additionally is the polysulfide liquor added to the first vessel heated from a heat source. While the heating is necessary in order to release steam, heating of the polysulfide is particular beneficial as the risk for plugging heat exchangers is low with this liquor free from any cellulose material that could be withdrawn in a liquor circulation.

The heated polysulfide liquor may be added directly into the vessel without further mixing with other liquors, but in a preferred embodiment of the invention is the polysulfide liquor added to the first circulation.

According to a preferred embodiment of the invention is the heat source used to heat the circulation and/or the polysulfide liquor the hot spent cooking liquor withdrawn from the second vessel. This spent cooking liquor holds full cooking temperature at withdrawal from the second cooking vessel and contains a considerable amount of heat value to be used when heating the liquors in the first vessel.

Alternatively the heat source used is steam, preferably steam from the low pressure steam net of the pulp mill. As the heating is done to reach temperatures close to 100° C., is the low pressure steam often enough, and is available most often in a mill in abundance. Medium pressure steam is more expensive and utilized for more demanding process conditions well over 100° C.

According to a most preferred mode of operation is the inventive method operated in line with conditions as outlined in WO2013032377, where the liquor in the first vessel has an alkali concentration above 60 g/l and a polysulfide concentration above 3 g/l, or above 0.09 mol/l, when adding the polysulfide cooking liquor, establishing a liquor-to-wood ratio in the range 2.0 to 3.2 in said first vessel. This establishment of the low liquor-to-wood ratio is however much easier to establish in the present invention, as the cellulosic material is not suspended in any liquor before feeding to the impregnation vessel. The added polysulfide liquor using the inventive method need therefore not to compete with bulk volumes of liquors brought into the impregnation vessel from the preceding feed system, as the cellulosic material contains no more liquid than the natural moisture content of the cellulosic material The lignin-containing cellulosic materials to be used in the present process are suitably softwood, hardwood, or annual plants.

BRIEF DESCRIPTION OF THE DRAWINGS

FIG. 1 is a schematic cooking system capable of implementing the inventive method.

DETAILED DESCRIPTION OF THE INVENTION

In FIG. 1 is shown a 2-vessel kraft cooking system, having a first atmospheric impregnation vessel A and a second steam/liquid phase digester B, wherein the inventive method could be implemented. The function of the system is described in following parts.

Feeding.

In this type of system is first the lignin containing cellulosic material, Chips, fed with a conveyor belt CB to the top of the atmospheric impregnation vessel A and sluiced into the top using a conventional sluice feeder SF. A first upper level of chips, $LE_1$, is established in the vessel. Simultaneously is impregnation liquid added to the vessel establishing a second lower level of liquid, $LE_2$. In this process is the new treatment liquid added as polysulfide liquor, identified as Orange Liquor in drawing, and between 80-100% of the total charge of alkali to the entire cooking process is charged in this position. In the embodiment shown in FIG. 1 is the polysulfide liquor added to a circulation established in the vessel A, comprising a withdrawal screen $SC_1$ in the vessel wall, piping and pumps leading the withdrawn treatment liquor back to center of vessel using a central pipe CP. The new polysulfide liquor could thus be distributed to the entire cross section of the vessel while being subjected to the circulation flow.

The second lower level of liquid $LE_2$ is established some 5-15 meter below the upper level of chips $LE_1$, and thus provides for a volume of cellulose material above the liquid level. This dense packed volume of cellulose material provides for a dead weight that drives a plug of cellulose material down and into the pool of liquor contained in the bottom of the vessel. The dense plug of cellulose material also provides for a condensation volume cooling and finally condensing any steam that may evaporate upwardly against the wood material that have been fed to top of vessel and is kept at lower temperature, preferably at ambient temperature.

Steaming

The cellulose material must be steamed in order to drive out bound air and enable a thorough impregnation. The air must be expelled to such an extent that the cellulose material loses its buoyancy, as well as enablement of impregnation to such an extent that the entire cellulose volume may be fully cooked and reduce the amount of rejects after the cook. No steaming process in practice is capable of expelling 100% of all air bound in the cellulose material, but most system drive out air to such an extent that the wood material loses its buoyancy as well as keeping the amount of rejects at acceptable levels. With the experience from ImpBin concepts it has been proven that the steaming concept used in ImpBin works to such an extent that even large chunks of cellulose material becomes fully impregnated and that the reject volumes in some cases are close to zero. In some implementations of ImpBin system was installation of huge reject bins recommended to mill operators by 3$^{rd}$ party consultants, but after some weeks of operations it was discovered that not even a toothpick sized reject volume was sent to the reject bin, which proves the perfect impregnation effect from using ImpBin in that installation. This should be compared with some perceptions in the pulping industry in the late 1980-ies that the cellulose material required extensive steaming effects in dedicated apparatuses, first steaming in a chip bin, and then also steaming in a separate steaming vessel at slightly higher pressure before suspending the steamed chips in liquor, which was the standard set up in conventional cooking until the late 1990-ties.

In the system disclosed is the major part steaming effect, or in some cases the entire steaming effect, obtained by addition of hot liquors having a temperature above 100° C., in this case hot liquors containing the polysulfide liquor, in center of vessel A, and due to the fact that the vessel is atmospheric is steam flashed off into the volume of cellulose material. The steam is released from the outlet end of the central pipe CP located in the lower end of the volume of cellulose material located above the second liquid level $LE_2$. In some cases could several central pipes be used to distribute the steam and the polysulfide liquor more evenly over the cross section, using the multipipe system as disclosed in EP2467533.

As disclosed is the liquors added to the vessel heated preferably using heat exchangers $HE_1$ and $HE_2$. Direct injection of steam may be used, but has the disadvantage that the polysulfide concentration decreases due to the dilution effect of steam condensate. Also, clean steam condensate is expensive to replace if lost, as even ordinary tap water needs thorough and expensive cleaning before use in the steam cycle, so preferably is the clean steam condensate from indirect heat exchangers sent back to the steam cycle.

A first heat exchanger $HE_1$ may be included in the circulation disclosed, and a second heat exchanger $HE_2$ may be included in supply pipe of the polysulfide liquor, and at least one of these heat exchanger systems are included if not both depending upon need for heating and the starting temperature of the polysulfide liquor.

In the most preferred embodiment and as disclosed in FIG. 1 is the first heat exchanger $HE_1$ using the heat value of the hot spent cooking liquor withdrawn from digester. The spent cooking liquor typically holds full cooking temperature, i.e. 130-160° C. at withdrawal, said temperatures obtained after using live steam from the medium pressure steam net of the mill. This high heat value is preferably used to heat the polysulfide liquor that conventionally is made on site of the mill and is stored in atmospheric tanks holding a temperature of about 70-80° C. Thus the polysulfide liquor may thus be heated easily to a temperature of about 110-130° C. before addition to the system using heat exchangers.

In the most preferred embodiment and as disclosed in FIG. 1 is the second heat exchanger $HE_2$ system using the heat value of low pressure steam using live steam from the low pressure steam net of the mill. The low pressure steam is most often available at abundance at the mill, in contrast to medium pressure steam, but is most suitable for heating purposes in the range 100-130° C. The heating obtained in the circulation by the second heat exchanger, preferably in combination with the heating of the polysulfide liquor, is most often sufficient for effective steaming of the cellulose material in warm climate where chips holds an ambient temperature of about 20-30° C. or even higher.

In particular demanding applications, for example in cold climate with ambient temperatures well below 0° C. and corresponding temperature of the cellulose material, additional steam may be supplied directly to the vessel A as disclosed, using low pressure steam using live steam from the low pressure steam net of the mill. This steam may be supplied in a distribution chamber in the wall of the digester located above the second liquid level $LE_2$, and preferably implemented as disclosed in EP2591165 previously used for black liquor impregnation in ImpBin and first implemented in cold climate mills.

With these alternatives for steaming no risk for emission of malodorous sulfur compounds may be experienced, as all liquors added contains no black liquor. The steaming concept may thus be optionally changed from the cold top control previously used in black liquor impregnation using ImpBin. If instead hot top control is implemented, allowing steam to blow through the entire cellulose volume located above the second liquid level $LE_2$, then the vented gases from the vessel may be sent to turpentine recovery, obtaining turpentine with less sulfur content.

The spent cooking liquor typically holds full cooking temperature, i.e. 130-160° C. at withdrawal, said temperatures obtained after This high heat value is preferably used to heat the polysulfide liquor that conventionally is made on site of the mill and is stored in atmospheric tanks holding a temperature of about 70-80° C.

A second heat exchanger system $HE_2$ may be included in the circulation disclosed, and a second heat exchanger system $HE_2$ may be included in supply pipe of the polysulfide liquor, and at least one of these heat exchanger systems are included if not both depending upon need for heating and the starting temperature of the polysulfide liquor. In the most preferred embodiment and as disclosed in FIG. 1 is the second heat exchanger system using the heat value of the hot spent cooking liquor withdrawn from digester. The spent cooking liquor typically holds full cooking temperature, i.e. 130-160° C. at withdrawal, said temperatures obtained after using live steam from the medium pressure steam net of the mill. This high heat value is preferably used to heat the polysulfide liquor that conventionally is made on site of the mill and is stored in atmospheric tanks holding a temperature of about 70-80° C.

Each heat exchanger may comprise a number of heat exchangers arranged in a system, not shown, using the hotter heating media in countercurrent mode such that the residual heat value in the heating media heats the coldest flow in a first heat exchanger, and the original heat value heats a flow that has passed at least on preceding heat exchanger in a second heat exchanger.

Feed from Impregnation to Cooking Vessel

Thus, the first impregnation stage in vessel is implemented in the vessel B and preferably only charged with the polysulfide cooking liquor and as small amount as possible of additional liquids such as wood moisture, steam condensates, and especially no black liquor nor additional water or filtrates. The resulting liquor-to-wood ratio established should be in the range 2.0 to 3.2 and the temperature should be in the range 100-120° C.

After the sufficient retention time in vessel A, which should have a retention time resulting in an H-factor in the range 1-20 of the impregnation stage, the impregnated cellulose material will be fed to the steam/liquid phase digester B together with the residual treatment liquor. In FIG. 1 is disclosed a transfer system with parallel centrifugal pumps, corresponding to what is disclosed in EP2268862 and/or EP2268861, but conventional sluice feeders may also be used. As disclosed could optionally additional air be supplied to top of digester, in form of pressurized air CA that could raise the pressure in digester top without excessive heating if higher pressure in top is sought for and using lower cooking temperatures. However, it should be realized that the invention may equally well be implemented with a hydraulic digester, i.e. a digester without a steam phase in top and completely filled with cooking liquor. Due to the low H-factor in impregnation the residual treatment liquor contains most of the original charge of alkali as virtually nothing has been consumed for delignification. Here is shown a conventional transfer system with dilution in bottom of the vessel B using withdrawn treatment liquor from the top separator TS in the top of vessel B sent via return line $TR_{RET}$. Also, a part of the hot spent cooking liquor withdrawn from a screen SC2 is added to the return line in order to raise the temperature ahead of cooking in vessel B. At the top of the digester vessel B is the cellulose material heated to full cooking temperature, in the range 130-160° C. depending upon type of cellulosic material. The heating to full digester temperature is conventionally done by adding medium pressure steam from the MP steam net of the mill. Additional liquid is added in order to reduce the alkali concentration at this point, which in this embodiment is a part of the withdrawn spent cooking liquors, withdrawn from screens $SC_2$ and $SC_3$. Most of the withdrawn spent liquor from screens $SC_2$ and $SC_3$ is sent to recovery REC, but the heat value is used first in heat exchanger $HE_1$ as disclosed, and then preferably is finally flashed in a flash tank FT to ambient pressure. The steam flashed off $ST_S$ is preferably sent to LVHC (Low Volume High Concentration)

or HVLC (High Volume Low Concentration) systems, the latter after diluting the gases, for disposal and preferably combustion of malodorous gases. As also disclosed is the flashed spent cooking liquor first sent to a knotter, and the knots screened out from the spent cooking liquor is sent to knot handling system and thereafter reintroduced into bottom of vessel A In this embodiment is shown a digester B with 2 concurrent cooking zones, one cooking zone above the first screen section $SC_2$ and a second cooking zone above the final screen section $SC_3$ in bottom of digester, but any kind of cooking scheme may be implemented in the digester vessel B. In a conventional manner is preferably a final counter current wash zone implemented in bottom of digester by addition of wash water/Wash. The final pulp with a kappa number below 40 is fed out from bottom in flow $P_{OUT}$.

Alternative Embodiments

The invention could be implemented in a number of different ways besides what is disclosed in FIG. 1. The digester vessel B could be operated according to EAPC, MCC, ITC or Lo-Solids Cooking, with or without additional charges of alkali to some digester circulations. If the impregnation vessel is operated with cold top then also black liquor may be added to impregnation vessel in order to reach the desired liquid-to-wood ratios necessary (if the charge of polysulfide liquor is not enough).

The invention claimed is:

1. A method for the preparation of kraft pulp with increased pulping yield from lignin-containing cellulosic material using polysulfide cooking liquor, comprising:

feeding the lignin containing cellulosic material which has not been previously steamed to the top of a first vessel operating at an applied pressure in the top of the first vessel of at most 0.2 bar, and establishing an upper level of lignin containing cellulosic material in the first vessel;

determining a total charge of alkaline cooking liquor in the form of polysulfide liquor for the first vessel;

heating the polysulfide liquor to a temperature above its boiling point, allowing water to evaporate off from the polysulfide liquor;

charging at least 80% of the total charge of the alkaline cooking liquor, in the form of the polysulfide liquor, to the first vessel and establishing a lower level of liquor below said upper level, thus keeping steam and the lignin containing cellulosic material in a volume above the lower level of liquor;

keeping the suspended lignin containing cellulosic material in the first vessel for a sufficient time to reach an H-factor of at least 1;

feeding the suspended lignin containing material from the bottom of the first vessel to the top of a second vessel and cooking the lignin containing cellulosic material at full cooking temperature in the range of from 130 to 160° C. to a final kappa number below 40, while adding any of the remaining charge of the alkaline cooking liquor, preferably in form of polysulfide liquor, during feeding to or cooking in the second vessel.

2. The method according to claim 1, including adding additional steam to the volume of the lignin containing cellulosic material kept above the lower level of liquor.

3. The method according to claim 1, wherein the liquor in the first vessel has an alkali concentration above 60 g/l and a polysulfide concentration above 3 g/l, when charging the polysulfide cooking liquor, establishing a liquor-to-wood ratio in the range 2.0 to 3.2 in said first vessel.

4. The method according to claim 1, including keeping the suspended liquor containing cellulosic material in the first vessel for a sufficient time to reach an H-factor between 1 and 20.

5. The method according to claim 1, wherein the liquor in the first vessel has an alkali concentration above 60 g/l and a polysulfide concentration above 0.09 mol/l, when charging the polysulfide cooking liquor, establishing a liquor-to-wood ratio in the range 2.0 to 3.2 in said first vessel.

6. A method for the preparation of kraft pulp with increased pulping yield from lignin-containing cellulosic material using polysulfide cooking liquor, comprising:

feeding the lignin containing cellulosic material which has not been previously steamed to the top of a first vessel operating at an applied pressure in the top of the first vessel of at most 0.2 bar, and establishing an upper level of lignin containing cellulosic material in the first vessel;

determining a total charge of alkaline cooking liquor in the form of polysulfide liquor for the first vessel;

heating the polysulfide liquor to a temperature above its boiling point, allowing water to evaporate off from the polysulfide liquor;

charging at least 80% of the total charge of the alkaline cooking liquor, in the form of the polysulfide liquor, to the first vessel and establishing a lower level of liquor below said upper level, thus keeping steam and the lignin containing cellulosic material in a volume above the lower level of liquor;

adding additional steam to the volume of the lignin containing cellulosic material kept above the lower level of liquor;

keeping the suspended lignin containing cellulosic material in the first vessel for a sufficient time to reach an H-factor of at least 1;

feeding the suspended lignin containing material from the bottom of the first vessel to the top of a second vessel and cooking the lignin containing cellulosic material at full cooking temperature in the range of from 130 to 160° C. to a final kappa number below 40, while adding any of the remaining charge of the alkaline cooking liquor, preferably in form of polysulfide liquor, during feeding to or cooking in the second vessel; and withdrawing a part of the liquor volume in the first vessel from the wall of the first vessel and circulating said part of the liquor volume back to the volume of the lignin containing cellulosic material in the first circulation.

7. The method according to claim 6, including heating the first circulation from a heat source.

8. The method according to claim 7, including adding the polysulfide liquor to the first circulation.

9. The method according to claim 6, including heating the polysulfide liquor added to the first vessel from a heat source.

10. The method according to claim 9, including adding the heated polysulfide liquor to the first circulation.

11. The method according to any of claim 7, wherein the heat source is hot spent cooking liquor withdrawn from the second vessel.

12. The method according to any of claim 7, wherein the heat source is steam.

13. The method according to claim 12, wherein the steam is from the low pressure steam out of a pulp mill.

* * * * *